US007578586B2

(12) United States Patent
Jones et al.

(10) Patent No.: US 7,578,586 B2
(45) Date of Patent: Aug. 25, 2009

(54) TRANSFIX ROLLER LOAD CONTROLLED BY FORCE FEEDBACK

(75) Inventors: Michael E. Jones, West Linn, OR (US); David L. Knierim, Wilsonville, OR (US); David D. Martenson, Oregon City, OR (US)

(73) Assignee: Xerox Corporation, Norwalk, CT (US)

( * ) Notice: Subject to any disclaimer, the term of this patent is extended or adjusted under 35 U.S.C. 154(b) by 520 days.

(21) Appl. No.: 11/270,215

(22) Filed: Nov. 8, 2005

(65) Prior Publication Data

US 2007/0103531 A1 May 10, 2007

(51) Int. Cl.
*B41J 2/01* (2006.01)

(52) U.S. Cl. ..... 347/104; 347/8; 347/101

(58) Field of Classification Search ..... 347/8, 347/101, 103, 104
See application file for complete search history.

(56) References Cited

U.S. PATENT DOCUMENTS 4,753,543 A * 6/1988 Mochimaru et al. ..... 400/703
5,703,553 A * 12/1997 Bushko et al. ..... 335/215
5,806,992 A * 9/1998 Ju ..... 400/56
6,585,368 B1 * 7/2003 Park ..... 347/103
6,983,934 B1 * 1/2006 Knierim ..... 271/262
2004/0103528 A1 * 6/2004 Okada ..... 29/716
2006/0011817 A1 * 1/2006 Harush et al. ..... 250/221
2006/0065060 A1 * 3/2006 Ito et al. ..... 73/862.046

* cited by examiner

*Primary Examiner*—Matthew Luu
*Assistant Examiner*—Henok Legesse
(74) *Attorney, Agent, or Firm*—Marger Johnson & McCollom, P.C.

(57) ABSTRACT

A printing device has an image receptor adapted to have an image formed thereon. The printing device also includes a transfer roller and a motor. A transfer roller load mechanism moves the transfer roller into contact with the image receptor in response to the motor output. A controller manipulates the motor in conjunction with a feedback signal from a load detector and regulates the load of the transfer roller.

11 Claims, 5 Drawing Sheets

TRANSFIX ROLLER LOAD CONTROLLED BY FORCE FEEDBACK

TECHNICAL FIELD

The present disclosure relates to printing machines, particularly machines in which marking material such as ink is transferred from a rotatably member such as a drum to a print sheet.

BACKGROUND

A solid ink printer typically uses a solid ink that is melted and jetted onto an image receptor prior to being transferred and fixed (transfixed) onto the media. A printer as that term is used here could be any device using a print engine, including copiers, fax machines, printers, multi-function devices (MFDs) that can print, fax, copy and scan, etc. The image receptor may be referred to as a drum for convenience, with no intention of limiting the transfer surface to a drum configuration. The image receptor may be supported by a drum or a belt.

The transfix process may include pressure and/or heat to transfer the image and fix it onto the media. Generally, a roller supplies the transfixing pressure in the nip. The nip is the region in which the image receptor and media come into contact to transfer the image. High-speed printers generally require controlled high pressures, generally in the range of about 550 pounds per square inch (approximately 250 kg/in$^2$) to more than 2000 psi (approx. 900 kg/in$^2$) depending on the particular solid ink compositions employed, the size of the recording medium, desired print quality (e.g., draft, final), applied heat, and the like.

Typically, pre-tensioned springs provide the pressure or load of the roller against the image receptor in the nip. A motor or other retracting means retracts the roller from the nip or extends the roller into the nip, against the tension of the spring(s) created by either of compression or extension of the spring from its resting state.

Tensioned springs generally deliver a slightly fluctuating roller load depending on variations in paper, device component run-out, etc. Pre-loaded springs may be unresponsive to dynamic mechanical aspects of the transfixing step. Using springs also requires more complicated manufacturing processes and result in bulkier products. Highly tensioned spring elements within a printing device chassis may potentially be dangerous to assembly and/or repair personnel. Inability to vary the force load based upon image content and print mode may cause the roller to run under more than necessary pressure all of the time, reducing roller life and increasing power consumption.

SUMMARY

A printing device has an image receptor adapted to have an image formed thereon. The printing device also includes a transfer roller and a motor. A transfer roller load mechanism moves the transfer roller into contact with the image receptor in response to the motor output. A controller manipulates the motor in conjunction with a feedback signal from a load detector and regulates the load of the transfer roller.

A printing device has a feedback control system including a force detector or sensor and a minimum function to limit the motor velocity such that the detected force substantially matches the reference force.

DETAILED DESCRIPTION

Figure 1:
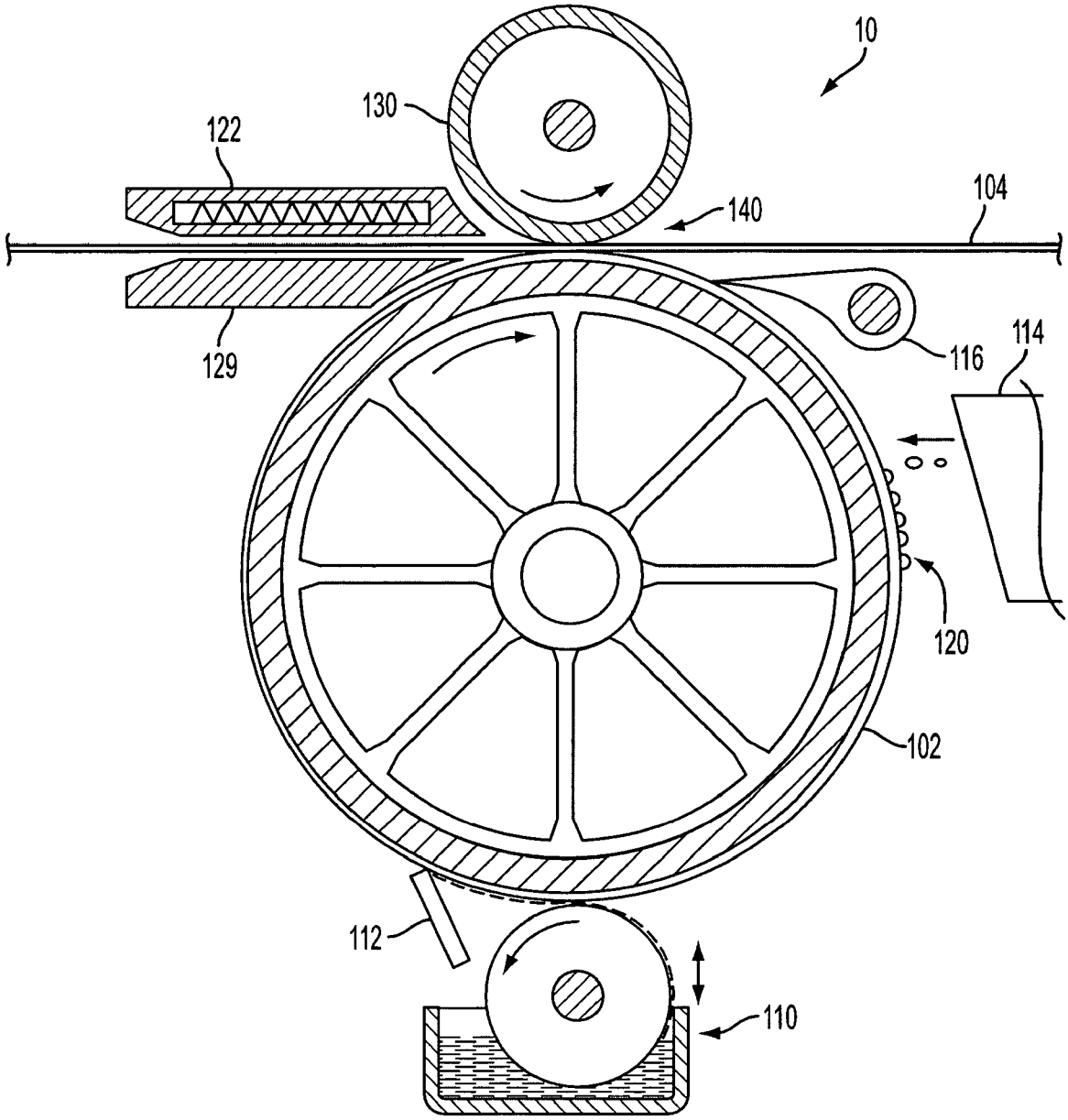
FIG. 1 shows a diagram of a printing system having a transfer roller.

FIG. 1 shows an example of a printer 10. The term printer as used here applies to any print engine, whether it is part of a printer, copier, fax machine, scanner or a multi-function device that has the capability of performing more than one of these functions. The printer has a print head 114 that deposits ink dot 120 on an image receptor 102 to form an image. A supporting surface, such as a drum or belt, supports the image receptor 102. The image receptor 102 may be a liquid applied by an applicator, web, wicking apparatus, metering blade assembly 112 from a reservoir 110.

The ink dots 120 form an image that is transferred to a piece of media 104 that is guided past the image receptor by a substrate guide 129, and a media pre-heater 122. In solid ink jet systems, the system pre-heats the ink and the media prior to transferring the image to the media in the form of the ink dots. A pressure roller 130 transfers and fixes (transfixes) the ink dots onto the media at the nip 140. The nip is the region in which the pressure roller pushes the media against the image receptor to transfer of the image. One or more stripper fingers, such as 116, may assist in lifting the media away from the image receptor.

Figure 2:
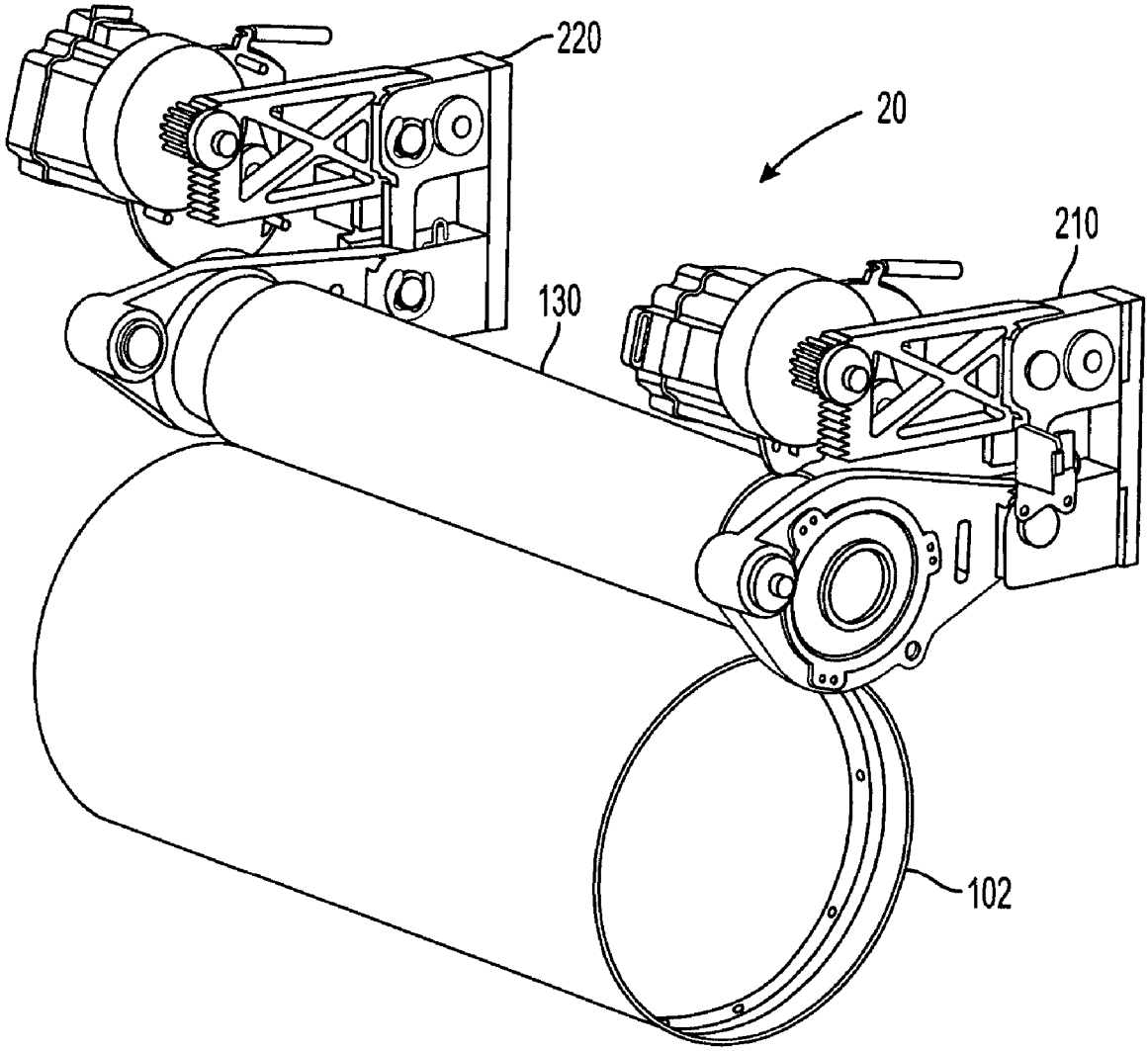
FIG. 2 shows a transfix load system.

A transfer roller load system 20 surrounds the transfer roller 130, as shown in FIG. 2. The transfer roller 130 may have at least one transfer roller load mechanism. The transfer roller load mechanism such as 210 or 220 causes the transfer roller 130 to move into contact with the image receptor 102. Initially, a uniform gap exists between the transfer roller 130 and the image receptor 102. In some embodiments, this gap is approximately 1 millimeter (mm).

Upon actuation of the transfer roller load mechanisms, shown in FIG. 2 as motors, the transfer roller contacts the image receptor. In some embodiments, a 0.55 mm gap is closed and approximately 90% of the final transfer roller load is developed within 50 ms. In some embodiments the transfer roller load is regulated at 2000 pounds of force, which would translate into 1000 pounds of force per side for the embodiments using two transfer roller load mechanisms.

In the embodiment of FIG. 2, the motors actuate in the clockwise direction. After the transfer operation is complete, the transfer roller load mechanism moves the rollers back to the initial position. In the embodiment of FIG. 2, the transfer roller load mechanism of the motors 210 and 220 rotate counterclockwise to move the roller out of contact with the image receptor 102.

Figure 3:
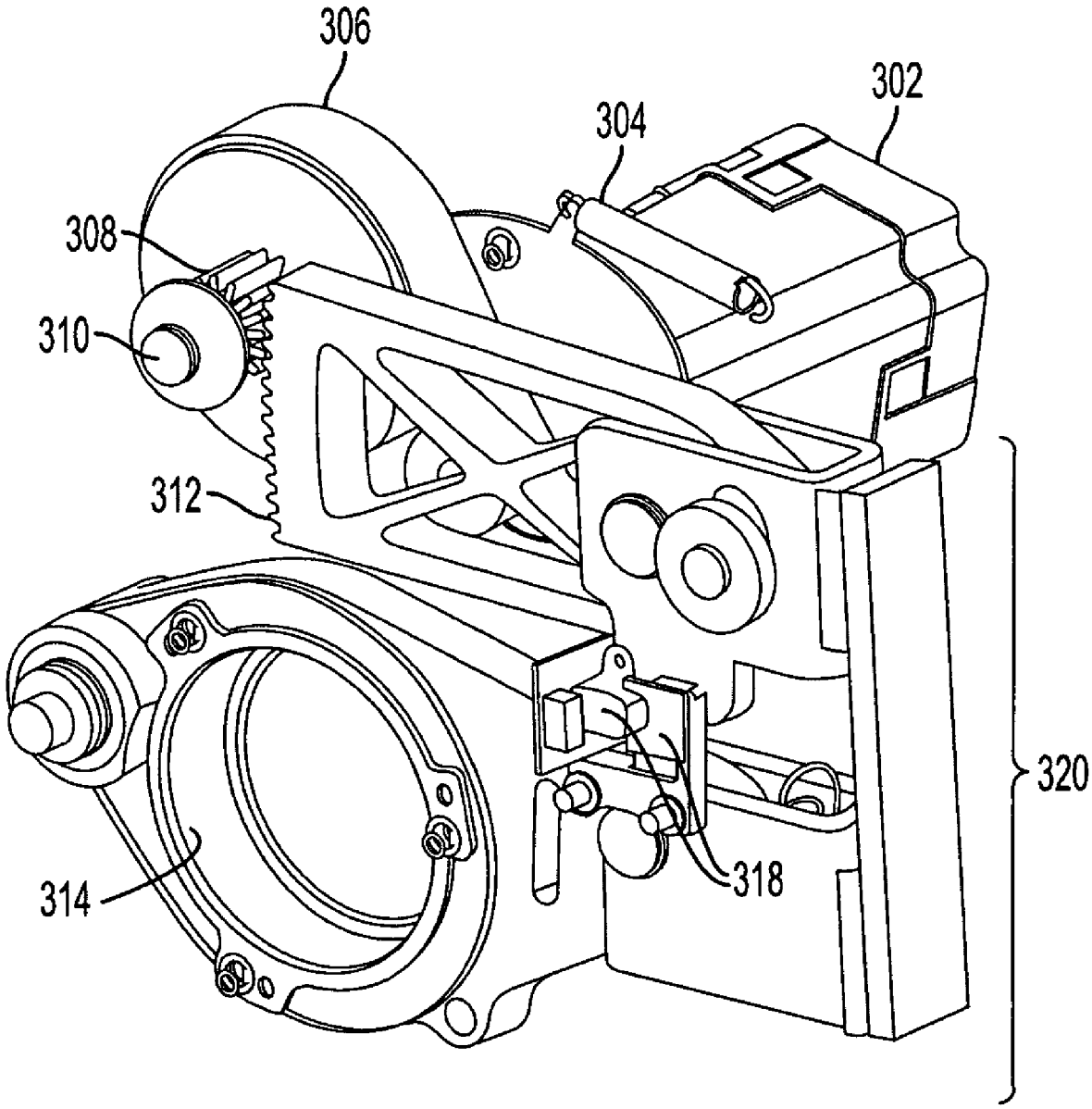
FIG. 3 shows a load mechanism within a transfix load system.

As mentioned above, the transfer roller load may be regulated at a particular measurement of pounds of force. A closed loop control system may provide this regulation. In some embodiments, regulation involves monitoring relative displacement between two ends of force sensing link within the transfer roller load mechanisms such as 210 and 220. FIG. 3 shows an embodiment of a load mechanism.

In FIG. 3, the transfer roller load mechanism employs motor 302 driving belt 306, which in turns drives compound pulley/gear 308. As will be discussed in more detail, this comprises only one example of a servo that can move the transfer roller. The motor 302 is fixed to the chassis, not shown for better viewing of the components of the load mechanism. This embodiment uses a motor having a belt drive tension spring 304 and a belt 306. The belt 306 drives a compound pulley/gear 308 to cause motion. The compound pulley/gear 308 moves about a bearing 310 that is fixed to the chassis (not shown). It must be noted that the load mechanism may employ other methods to couple the motor to the gear, such as a band drive, a worm gear, direct drive, or one or more conventional meshed gears. The combination of motor and coupling is referred to here as a geared motor.

The output of the motor at the gear 308 causes the sector gear 312 positioned to engage with gear 308 to move. Movement of the sector gear 312 causes the force sensing link 320 to move a transfer roller retainer 314 that holds the transfer roller, not shown here for better viewing of the components of the load mechanism. When the sector gear 312 moves, it causes relative displacement between the two ends of force sensing link 320 allowed by a flexure 410, shown in FIG. 4, in one embodiment. A sensor 318 may detect this displacement and a signal from the sensor 318 may provide input to a feedback system to allow load regulation at the transfer roller in the nip.

Figure 4:
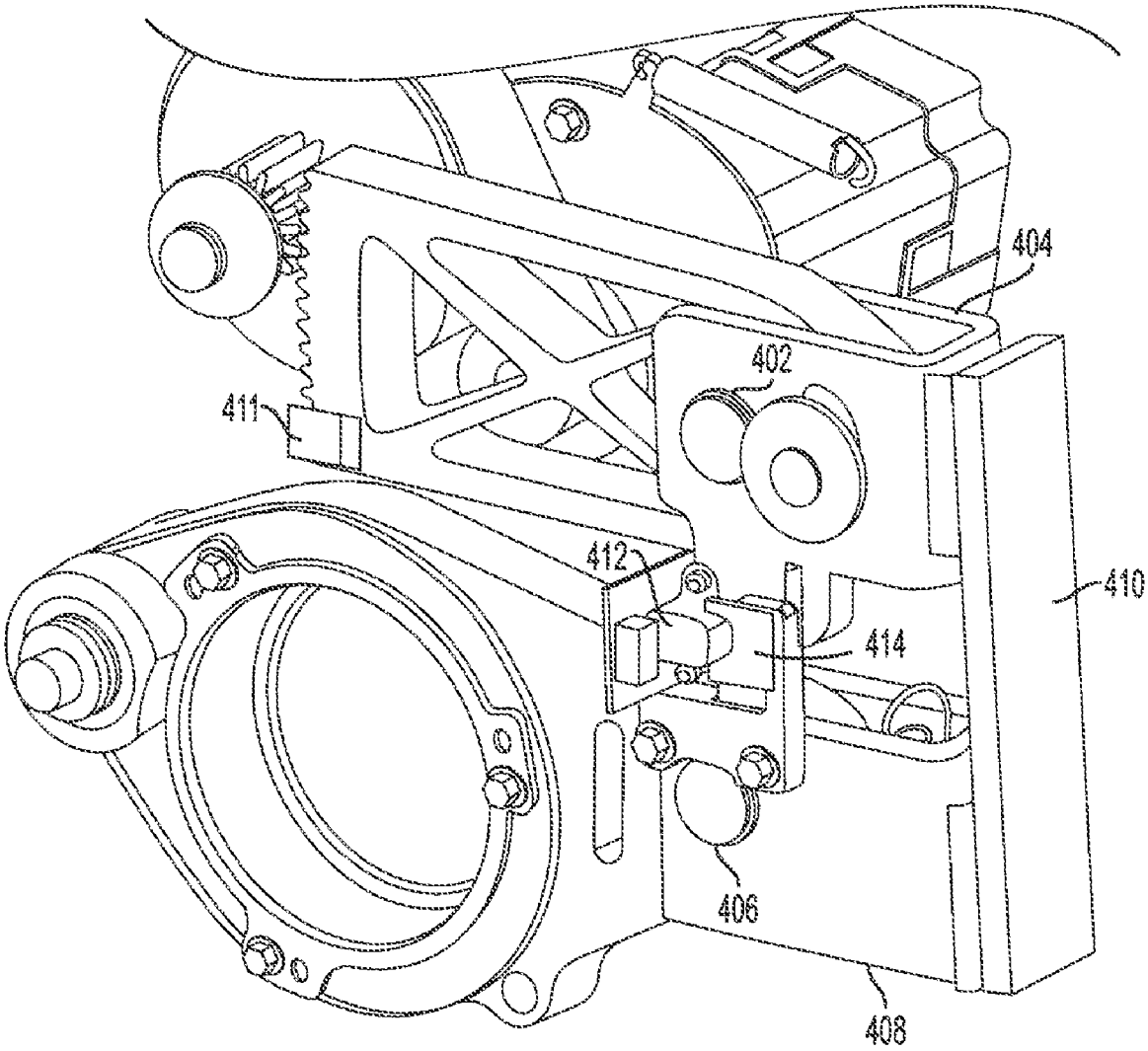
FIG. 4 shows a load sensor within a load mechanism.

FIG. 4 shows an embodiment of a force sensing link. The sector gear 312 from FIG. 3 is coupled to a first flexure arm 404 having a first flexure pin 402. The transfer roller retainer 314 is coupled to a second flexure arm 408 having a second flexure pin 406. For ease of discussion, the first flexure arm may be referred to as the upper flexure arm and the second flexure arm may be referred to as the lower flexure arm, with the understanding that orientation is not so limited.

As the transfer roller load increases, the force between pins 402 and 406 increases. The flexure arms 404 and 408 carry the force to the flexure 410. Due to the length of the arms, the force induces a moment in the flexure and causes the flexure to bend proportionally with the transfer roller force.

The flexure could be any member having spring properties, such as the flexure shown or a flexible link. For example, any member having a spring rate in the range of 1000-10,000 Newtons/millimeter (N/mm), may be an embodiment of the flexure.

The bend in the flexure causes the distance between the pins 402 and 406 to change. A sensor residing between the pins may detect and measure the relative displacement representing the change of distance between the pins 402 and 406.

In an alternative embodiment, the sector gear itself could be design to act as a flexure under load. In this case, the flexure embodiment here of element 410 being a flexible link would be altered to a rigid link between the two pins. The displacement sensor would be relocated to the sector gear as shown by location 411.

Figure 5:
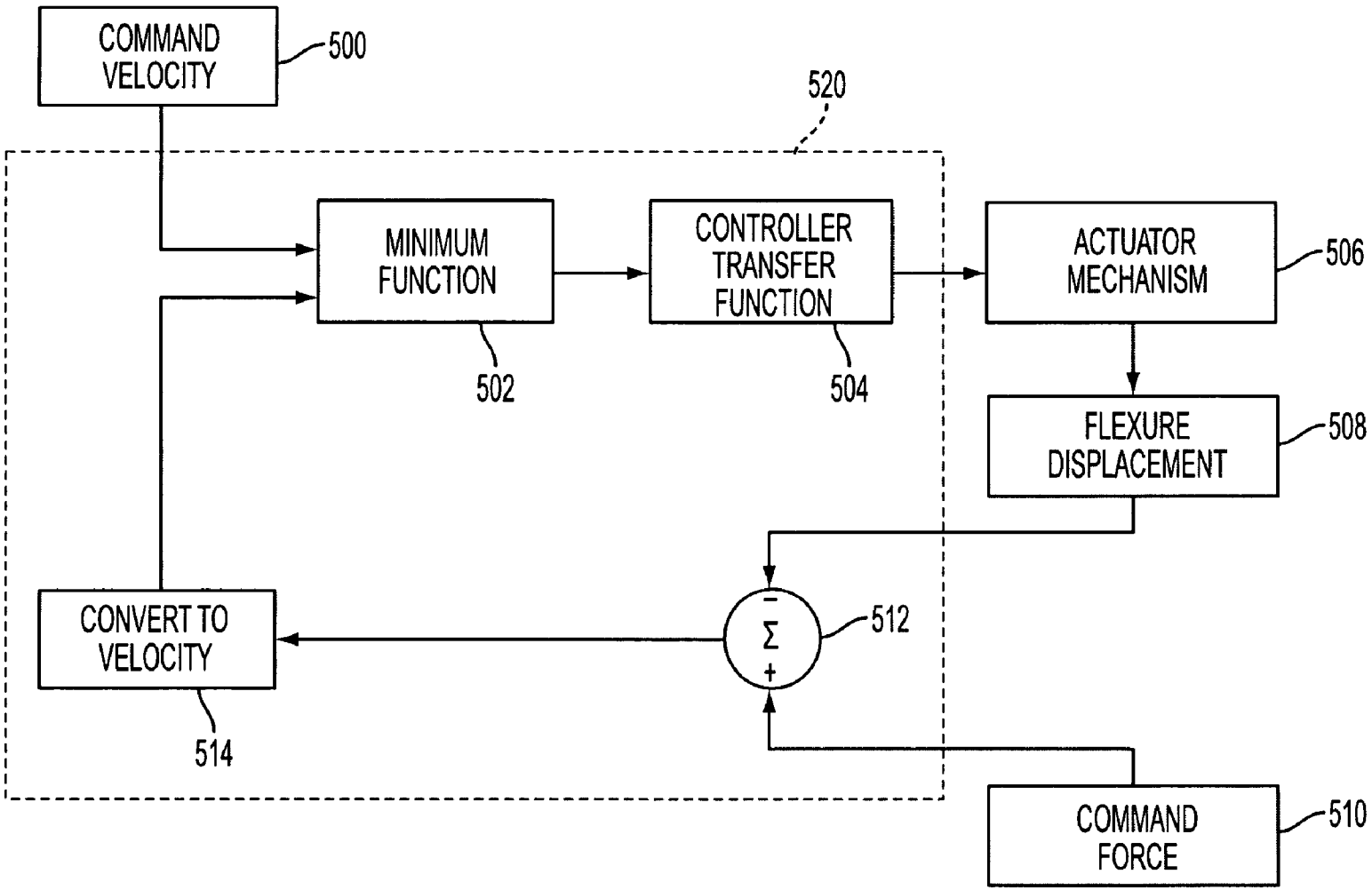
FIG. 5 is a diagram of a control circuit for the transfer roller pressure loading system.

In the embodiment shown in FIG. 4, the displacement sensor comprises an encoder 412 attached to the upper flexure arm and the corresponding encoder strip 414 to the lower flexure arm. The encoder measures the relative displacement of the pins. It must be noted that the load sensor may employ other types of sensors than an encoder, including a capacitive sensor in which a change of capacitance may signal displacement, transmissive or reflective photodiodes to detect a change in distance using transmission times or intensity of transmitted light, a strain gauge to measure strain in the flexure, and a piezoelectric element that changes as the flexure flexes, as examples. The measurement is proportional to the force applied, and may be referred to here as the detected force. An embodiment of a control system using this detected force as a feedback is shown in FIG. 5.

Assuming that the gap exists initially, a command velocity 500 is input into the system with a positive polarity to close the gap. The command force 510 is the force requested from the system. There is no detected force, in this embodiment shown as the flexure displacement 508, so the minimum function will select the command velocity 500 at 502. The minimum function may be implemented in many ways, including in a controller or control processor, as will be discussed in more detail further.

The minimum function passes the command velocity, at least initially, to the controller transfer function 504 that converts the value into an adjustment to the actuator mechanism 506. In the above embodiments, this actuator mechanism was demonstrated as a motor or motors. The controller transfer function 504 may adjust the velocity of the motors based upon the velocity value received from the minimum function.

Upon actuation of the mechanism at 506, the flexure beam discussed previously bends and the force (degree of bending) is measured by the load detector or sensor. This measured force is then provided to a summing function 512 that subtracts it from the command force. The resulting value is then converted to a velocity and provided to the minimum function. As the gap closes, the difference between the command and measured forces, converted to velocity, becomes smaller than the command velocity, resulting in the velocity of the actuator mechanism being regulated by the force path. The force path includes the flexure force feedback signal, resulting in the velocity of the motor being regulated by the flexure force signal.

When the gap is to be opened, a negative command velocity is provided at 500, which becomes the minimum value selected by the minimum function 502. The negative velocity changes the movement of the actuator to re-open the gap. The control of the motor is accomplished by the minimum function, the controller transfer function and the feedback signal. These may be embodied in a controller that receives the command force 510, the command velocity 500, and the flexure measured force 508 or other load detection signal as inputs. The controller 520 is shown by the dashed lines around the various functions. This may be embodied in a set of instruction in a processor, a dedicated controller, digital signal processor, application specific integrated circuit, etc.

In this manner, the adjustment of the motor is based upon the actual force detected, rather than an approximation. This provides more accurate measurement of the applied load to the image receptor, allowing for better control of the printing process that may vary according to a print setting. As mentioned previously, it may be desirable to reduce or increase the load depending upon print settings such as desired print quality, recording medium size, recording medium type, image parameters, print speed, and image composition Although an ink-jet printer has been described here, the disclosed apparatus and method can be applied to other printing technologies. Examples include offset printing and xerography, also known as electrophotography.

It will be appreciated that various of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

The invention claimed is:

1. A printing device, comprising:

an image receptor adapted to have an image formed thereon;

a transfer roller;

a motor to produce a motor output;

a transfer roller load mechanism to move the transfer roller into contact with the image receptor in response to the motor output, the transfer roller load mechanism comprising:

a sector gear positioned to be engaged with the motor;

a first flexure arm having a first flexure pin coupled to the sector gear;

a second flexure arm having a second flexure pin coupled to the transfer roller; and a flexure connecting the first flexure arm to the second flexure arm and to flex when the sector gear is moved in response to the motor;

a load detector within the transfer roller load mechanism; and a controller to regulate a transfix load of the transfer roller in response to an output from the load detector.

2. The printing device of claim 1, the transfer roller load mechanism further comprising one selected from the group consisting of: a belt drive, a worm drive, a band drive and a gear drive.

3. The printing device of claim 1, the printing device further comprising a second transfer roller load mechanism, one transfer roller load mechanism arranged at either end of the transfer roller.

4. The printing device of claim 1, the load detector comprising one selected from the group consisting of: a piezoelectric element, a strain gauge coupled to a flexure, a flexible link and a displacement sensor responsive to flexing of the flexible link.

5. The printing device of claim 1, the load detector being located on the first flexure arm.

6. The printing device of claim 4, the load detector further comprising a flexible link and a displacement sensor, the displacement sensor comprising one selected from the group consisting of: an encoder and encoder strip, a capacitive sensor, transmissive photodiode sensor, and a reflective photodiode sensor.

7. A printing device, comprising:

an image receptor adapted to have an image formed thereon;

a transfer roller;

a motor to produce a motor output;

a transfer roller load mechanism to move the transfer roller into contact with the image receptor in response to the motor output, the transfer roller load mechanism further comprising:

a sector gear positioned to be engaged with the motor;

a first flexure pin coupled to the sector gear;

a second flexure pin coupled to the transfer roller; and a rigid link connecting the first flexure pin with the second flexure pin.

8. The printing device of claim 7, the load detector being located on the sector gear.

9. The printing device of claim 7, the printing device further comprising a second transfer roller load mechanism, one transfer roller load mechanism arranged at either end of the transfer roller.

10. The printing device of claim 7, the load detector comprising one selected from the group consisting of: a piezoelectric element, a strain gauge coupled to a flexure, a flexible link and a displacement sensor responsive to flexing of the flexible link.

11. The printing device of claim 7, the load detector further comprising a flexible link and a displacement sensor, the displacement sensor comprising one selected from the group consisting of: an encoder and encoder strip, a capacitive sensor, transmissive photodiode sensor, and a reflective photodiode sensor.

* * * * *